US005485824A

United States Patent [19]

Kondou

[11] Patent Number: 5,485,824

[45] Date of Patent: Jan. 23, 1996

[54] ELECTRONIC CONTROL DEVICE FOR AN INTERNAL COMBUSTION ENGINE

[75] Inventor: Katsuhiko Kondou, Himeji, Japan

[73] Assignee: Mitsubishi Denki Kabushiki Kaisha, Tokyo, Japan

[21] Appl. No.: 308,512

[22] Filed: Sep. 21, 1994

[30] Foreign Application Priority Data

Jun. 30, 1994 [JP] Japan ..... 6-149755

[51] Int. Cl.[6] ..... F02M 33/02; F02M 25/08

[52] U.S. Cl. ..... 123/520

[58] Field of Search ..... 123/518, 519, 123/520, 698

[56] References Cited

U.S. PATENT DOCUMENTS

| | | | |
|---|---|---|---|
| 5,090,388 | 2/1992 | Hamburg et al. | 123/520 |
| 5,216,997 | 6/1993 | Osanai et al. | 123/698 |
| 5,224,456 | 7/1993 | Hosoda et al. | 123/520 |
| 5,245,978 | 9/1993 | Orzel | 123/698 |
| 5,257,613 | 11/1993 | Monda et al. | 123/698 |
| 5,299,544 | 4/1994 | Kitamoto et al. | 123/520 |
| 5,351,193 | 9/1994 | Poirier et al. | 123/520 |
| 5,355,862 | 10/1994 | Muramatsu et al. | 123/520 |
| 5,368,002 | 11/1994 | Hoshino et al. | 123/520 |
| 5,372,117 | 12/1994 | Denz et al. | 123/520 |
| 5,404,862 | 4/1995 | Ohta et al. | 123/698 |

FOREIGN PATENT DOCUMENTS

| | | |
|---|---|---|
| 45442 | 2/1988 | Japan . |
| 255559 | 10/1988 | Japan . |

*Primary Examiner*—Thomas N. Moulis
*Attorney, Agent, or Firm*—Sughrue, Mion, Zinn, Macpeak & Seas

[57] ABSTRACT

An electronic control device for an internal combustion engine 1 for controlling the air-fuel ratio of a mixture of air and fuel supplied to the engine 1 is provided. A purge passage 6 is provided between the engine 1 and a fuel tank 19 to supply evaporated fuel from the fuel tank 19 to the engine 1. Furthermore, a canister 18 is provided in the purge passage 6 to store the evaporated fuel, and a purge control valve 7 is placed between the canister 18 and the engine 1 to vary the amount of fuel vapor which is supplied to the engine 1. The control device controls the flow rate of the fuel vapor from the canister 18 to the engine 1 by controlling the length of time and the amount which the purge control valve 7 is opened. In order to accurately determine how long and to what degree to open the valve 7, the control device considers how long the purge control valve 7 has been closed immediately before it is opened. Furthermore, the control device may also take into account other operating conditions of the engine 1, such as the rotating speed of the engine 1, the position of the throttle valve 16, and the temperature of the intake air, when determining how long to open the purge control valve 7.

12 Claims, 7 Drawing Sheets

ELECTRONIC CONTROL DEVICE FOR AN INTERNAL COMBUSTION ENGINE

BACKGROUND OF THE INVENTION

1. Field of the Invention

The present invention relates to an electronic control device for an internal combustion engine, particularly to a purge control which supplies evaporated fuel generated in a fuel tank to an engine.

2. Discussion of Background

FIG. 6 is a construction diagram of a conventional air-fuel ratio control device of an engine disclosed, for instance, in Japanese Unexamined Patent Publication No. 255559/1988. In FIG. 6, a throttle valve 16, a surge tank 17 and an injector 3 are successively installed at an intake air passage 2 which supplies intake air to a combustion chamber 15 of an engine 1. An evaporated fuel discharge passage 6 is connected to the intake air passage 2 downstream from the throttle valve 16. The upstream end of the evaporated fuel discharge passage 6 is connected to a canister 18 of an evaporated fuel discharge restraining device 5 through a control valve 7 which is driven by a duty solenoid valve. The canister 18 incorporates an adsorbent which adsorbs the evaporated fuel. The evaporated fuel from a fuel tank 19 is supplied to the intake air passage 2 through the evaporated fuel discharge passage 6 when the control valve 7 is operated to open, in accordance with an opening degree of the control valve.

An air-fuel ratio sensor 21 is installed at an exhaust passage 8 which is an air-fuel ratio detecting means. Detecting signals of the air-fuel ratio sensor 21 are outputted to a control unit 22. Fuel injection pulses are outputted to the injector 3 based on a feedback control whereby the detected air-fuel ratio conforms to a target air-fuel ratio in accordance with the output of the detecting signal. A duty control signal is outputted from the control unit 22 to the control valve 7 whereby the opening degree, that is, a supply quantity of the evaporated fuel is controlled.

The control unit 22 is respectively inputted with a rotation signal of the engine from a rotation sensor 23, an intake air quantity signal from an intake air quantity sensor 24 and a throttle signal from a throttle sensor 25 which detects the opening degree of the throttle valve 16, for detecting a running condition of the engine. Further, the control unit 22 fundamentally calculates basic fuel injection pulses from the intake air quantity and the rotation number of the engine and calculates final injection pulses by correcting the basic fuel injection pulses by various conditions such as the output of the air-fuel sensor 21 thereby forming an output to the injector 3. A flow chart is shown in FIG. 7 which shows these controls.

Further, a duty signal is determined from a map which has been predetermined in accordance with the running condition of the engine 1, and the duty signal is outputted to the control valve 7. A dulling treatment is performed wherein the duty signal gradually increases when a supply quantity of the evaporated fuel is increasing. On the other hand, the duty signal is controlled to decrease without performing the dulling treatment when the supply quantity of the evaporated fuel is decreasing. Normally, the supply quantity of the evaporated fuel is reduced in a deceleration period. In the deceleration period, fuel adhered to the intake air passage 2 is also supplied to the combustion chamber 15. Therefore, when the evaporated fuel is gradually reduced, large amounts of the evaporated fuel and the adhered fuel are supplied to the combustion chamber 15, whereby the air-fuel ratio is considerably deviated. To prevent the above phenomena, the dulling treatment is not performed when the supply quantity of the evaporated fuel is decreasing.

Further, there is a case disclosed in, for instance, Japanese Unexamined Patent Publication No. 45442/1988, wherein the operation copes with the considerable deviation of the air-fuel ratio due to the execution of the purge control by expanding a range of the air-fuel ratio control in which an air-fuel ratio correction coefficient of the air-fuel ratio control can be provided, when the purge control is performed.

The former conventional air-fuel ratio control device of the engine has been constructed as above, wherein the dulling treatment is performed such that the supply quantity of the evaporated fuel gradually increases. However, the control is performed by a constant amount of dulling treatment irrespective of the concentration of fuel vapor. Therefore, when the concentration of the fuel vapor is large, the influence thereof on the air-fuel ratio is considerable, which significantly deteriorates the exhaust gas. Further, when the concentration of the fuel vapor is small, the purge control can not sufficiently be performed. Further, in the other conventional device, the control range of the air-fuel ratio control is always expanded when the purge control is being performed. The control range is expanded even when the expansion of the control range is not necessary, which gives rise to a possibility of an erroneous operation by noise or the like, whereby the operation becomes unstable.

SUMMARY OF THE INVENTION

It is an object of the present invention to solve the above problems and to provide an electronic control device for an internal combustion engine capable of performing a sufficient purging operation and also capable of accurately performing an air-fuel ratio control.

According to a first aspect of the present invention, there is provided an electronic control device for an internal combustion engine comprising:

fuel controlling means for controlling a quantity of fuel supplied to an engine;

an air-fuel ratio sensor for detecting an air-fuel ratio from an exhaust gas;

air-fuel ratio controlling means for calculating an air-fuel ratio correction coefficient such that the air-fuel ratio of a mixture supplied to the engine becomes a predetermined value based on a signal from the air-fuel ratio sensor and for controlling the fuel controlling means by a feedback control;

a purge passage for supplying to the engine evaporated fuel which has evaporated in a fuel tank;

a canister provided in the purge passage for adsorbing the evaporated fuel;

fuel vapor flow rate calculating means for switching on or off a purge control in correspondence to a running condition of the engine and for calculating a flow rate of fuel vapor wherein the evaporated fuel which has been adsorbed by the canister is mixed with air in accordance with an operating state of the engine when the purge control is switched on; and purge controlling means for driving a purge control valve provided between the canister and an intake air passage such that the calculated flow rate of the fuel vapor is supplied to the engine;

wherein the fuel vapor flow rate calculating means corrects the flow rate of the fuel vapor when the purge control is switched, on based on at least a period of time that the purge control has been switched off immediately before the purge control is switched on.

According to a second aspect of the present invention, there is provided an electronic control device for an internal combustion engine comprising:

fuel controlling means for controlling a quantity of fuel supplied to an engine;

an air-fuel ratio sensor for detecting an air-fuel ratio from an exhaust gas;

air-fuel ratio controlling means for calculating an air-fuel ratio correction coefficient such that the air-fuel ratio of a mixture supplied to the engine becomes a predetermined value based on a signal from the air-fuel ratio sensor and for controlling the fuel controlling means by a feedback control;

a purge passage for supplying to the engine evaporated fuel which has evaporated in a fuel tank;

a canister provided in the purge passage for adsorbing the evaporated fuel;

fuel vapor flow rate calculating means for switching on or off a purge control in correspondence to a running condition of the engine and for calculating a flow rate of fuel vapor wherein the evaporated fuel which has been adsorbed by the canister is mixed with air in accordance with an operating state of the engine when the purge control is switched on; and purge controlling means for driving a purge control valve provided between the canister and an intake air passage such that the calculated flow rate of the fuel vapor is supplied to the engine;

wherein the fuel vapor flow rate calculating means corrects the flow rate of the purge air when the purge control is switched on based on at least a period of time that the purge control has been switched off immediately before the purge control is switched on a degree which the purge control valve was opened during a preceding period of time during which the purge control was switched on, and a length of the preceding period of time.

According to a third aspect of the present invention, there is provided the electronic control device for an internal combustion engine according to the first aspect or the second aspect, wherein the fuel vapor flow rate calculating means switches initial values of control by a temperature of the engine or a surrounding temperature in starting the engine.

According to a fourth aspect of the present invention, there is provided the electronic control device for an internal combustion engine according to any one of the first aspect through the third aspect, wherein the fuel vapor flow rate calculating means calculates a correction value a size of which gradually changes in one direction in correspondence to an opening degree of the purge control valve when the purge control is switched on and gradually changes in other direction when the purge control is switched off thereby correcting the flow rate of the purge air when the purge control is switched on.

According to a fifth aspect of the present invention, there is provided the electronic control device for an internal combustion engine according to the fourth aspect, wherein the fuel vapor flow rate calculating means restrains the change of the correction value of the flow rate of the fuel vapor when the purge control is switched off in case wherein an amount of the evaporated fuel generated in the fuel tank is determined to be small.

According to a sixth aspect of the present invention, there is provided the electronic control device for an internal combustion engine according to the fourth aspect or the fifth aspect, wherein the fuel vapor flow rate calculating means restrains the change of the correction value of the flow rate of the fuel vapor when the purge control is switched on in case wherein the engine is determined to be in a high load state.

According to a seventh aspect of the present invention, there is provided the electronic control device for an internal combustion engine according to any one of the fourth aspect through the sixth aspect, wherein the fuel vapor flow rate calculating means stops the change of the correction value of the flow rate of the fuel vapor when the purge control is switched on in case wherein the air-fuel ratio correction coefficient of the air-fuel ratio controlling means is out of a predetermined range.

According to an eighth aspect of the present invention, there is provided the electronic control device for an internal combustion engine according to any one of the fourth aspect through the seventh aspect, wherein a control range of an air-fuel ratio correction coefficient of the air-fuel ratio controlling means is expanded in case wherein the correction value of the flow rate of the fuel vapor of the fuel vapor flow rate calculating means becomes a value correcting to reduce the flow rate of the fuel vapor by not less than a predetermined value.

According to a ninth aspect of the present invention, there is provided the electronic control device for an internal combustion engine according to any one of the fourth aspect through the eighth aspect, wherein a quantity of change of the air-fuel ratio correction coefficient of the air-fuel ratio controlling means is increased in case wherein the correction value of the flow rate of the fuel vapor of the fuel vapor flow rate calculating means becomes a value correcting to reduce the flow rate of the fuel vapor by not less than a predetermined value.

According to a tenth aspect of the present invention, there is provided the electronic control device for an internal combustion engine according to any one of the fourth aspect through the ninth aspect, further comprising:

air-fuel ratio learning correcting means for calculating an air-fuel ratio learning correction quantity from the air-fuel ratio correction coefficient of the air-fuel ratio controlling means thereby correcting a quantity of fuel supplied to the engine;

wherein a calculating speed of the air-fuel ratio learning correction quantity of the air-fuel ratio learning correcting means is accelerated in case wherein the correction value of the fuel vapor of the fuel vapor flow rate calculating means becomes a value correcting to reduce the flow rate of the fuel vapor by not less than a predetermined value.

According to an eleventh aspect of the present invention, there is provided the electronic control device for an internal combustion engine according to any one of the fourth aspect through the ninth aspect, further comprising:

air-fuel ratio learning correcting means for calculating an air-fuel ratio learning correction quantity from the air-fuel ratio correction coefficient of the air-fuel ratio controlling means thereby correcting a quantity of fuel supplied to the engine;

wherein a calculation of the air-fuel ratio learning correction quantity of the air-fuel ratio learning correcting means is prohibited in case wherein the air-fuel correction coefficient of the air-fuel ratio controlling means is out of a predetermined range.

According to a twelfth aspect of the present invention, there is provided the electronic control device for an internal combustion engine according to any one of the fourth aspect through the eleventh aspect, wherein the fuel vapor flow rate calculating means switches ratios of change of the correction value of the flow rate of the fuel vapor by a temperature of the engine or a surrounding temperature in starting the engine.

According to the first aspect of the present invention, the electronic control device for an internal combustion engine predicts an amount of evaporated fuel which has been adsorbed in the canister during a period wherein the purge control has been switched off from at least the length of another period which has been immediately before the purge control is switched on and during which the purge control has been switched off. The flow rate of the fuel vapor when the purge control is switched on, is corrected in accordance thereto. That is, when the amount of the evaporated fuel in the canister is large, the flow rate of the fuel vapor is decreased, since the concentration of the fuel vapor is considered to be large, whereas, when the amount of the evaporated fuel in the canister is small, the flow rate of the fuel vapor is increased, since the concentration of the fuel vapor is considered to be small.

According to the second aspect of the present invention, the electronic control device predicts the amount of the evaporated fuel which has been adsorbed in the canister during a period wherein the purge control has been switched off, at least from the length of another period which has been immediately before the purge control is switched on and during which the purge control has been switched off, and further accurately predicts the amount of the evaporated fuel which remains in the canister when the purge control is switched off, from the opening degree of the purge control valve in the preceding period during which the purge control was switched on and the length of the preceding period.

According to the third aspect of the present invention, the electronic control device predicts the amount of the evaporated fuel which has been generated in the fuel tank before starting the engine, by the engine temperature or the surrounding temperature in starting the engine, and switches the initial values of control, to perform the control in correspondence to the predicted amount of the evaporated fuel.

According to the fourth aspect of the present invention, the electronic control device calculates the correction value the size of which gradually changes in one direction in correspondence to the opening degree of the purge control valve when the purge control is switched on, and gradually changes in other direction when the purge control is switched off, in order to correspond the correction value of the flow rate of the fuel vapor to the decrease in the concentration of the fuel vapor which is accompanied by the decrease in the amount of the evaporated fuel in the canister by performing the purge control, and the increase in the concentration of the fuel vapor which is accompanied by newly adsorbing the evaporated fuel in the canister during the period wherein the purge control has been switched off, thereby correcting the flow rate of the fuel vapor when the purge control is switched on.

According to the fifth aspect of the present invention, when the evaporated fuel which has been generated in the fuel tank is determined to be small, the amount of the evaporated fuel which has newly been adsorbed in the canister is very small even in the period wherein the purge control has been switched off, the amount of the evaporated fuel is considered to be in a degree which does not influence on the concentration of the fuel vapor, and therefore, the control device restrains the change of the correction value of the flow rate of the fuel vapor when the purge control has been switched off, in correspondence thereto.

According to the sixth aspect of the present invention, when the engine is in a high load state, the pressure at the intake air passage of the engine is increased, almost no fuel vapor can be supplied to the engine even when the purge control valve is opened, and the concentration of the fuel vapor does not change at all. Therefore, the control device restrains the change of the correction value of the flow rate of the fuel vapor when the purge control is switched on, in correspondence thereto.

According to the seventh aspect of the present invention, when the air-fuel ratio correction coefficient of the air-fuel ratio controlling means is out of a predetermined range, the air-fuel ratio is considered to deviate considerably by performing the purge control, and therefore, the control device stops the change of the correction value of the flow rate of the fuel vapor when the purge control is switched on, to prevent the control from further deviating the air-fuel ratio.

According to the eighth aspect of the present invention, when the correction value of the flow rate of the fuel vapor becomes a value correcting to reduce the flow rate of the fuel vapor by not less than a predetermined value, it is predicted that the air-fuel ratio is considerably deviated by performing the purge control, and therefore, the control device expands the control range of the air-fuel ratio correction coefficient to promote the response performance of the air-fuel ratio control.

According to the ninth aspect of the present invention, when the correction value of the flow rate of the fuel vapor becomes a value correcting to reduce the flow rate of the fuel vapor by not less than a predetermined value, it is predicted that the air-fuel ratio is considerably deviated by performing the purge control, and therefore, the control device increases the quantity of change of the air-fuel ratio correction coefficient to promote the response performance of the air-fuel ratio control.

According to the tenth aspect of the present invention, when the correction value of the flow rate of the fuel vapor becomes a value correcting to reduce the flow rate of the fuel vapor by not less than a predetermined value, it is predicted that the air-fuel ratio is considerably deviated by performing the purge control, and therefore, the control device accelerates the calculating speed of the air-fuel ratio learning correction quantity to promote the response performance of the air-fuel ratio control.

According to the eleventh aspect of the present invention, when the air-fuel ratio correction coefficient is out of a predetermined range, it is considered that the air-fuel ratio is considerably deviated, and therefore, the control device prohibits the calculation of the air-fuel ratio learning correction quantity such that the deviation is not reflected on the air-fuel ratio learning correction quantity.

According to the twelfth aspect of the present invention, the control device predicts the amount of the evaporated fuel which has been generated in the fuel tank before starting the engine, by the engine temperature or the surrounding temperature in starting the engine, and switches the ratios of change of the correction value of the flow rate of the fuel vapor to perform a control in accordance with the predicted quantity.

DETAILED DESCRIPTION OF THE PREFERRED EMBODIMENTS

EXAMPLE 1

Figure 1:
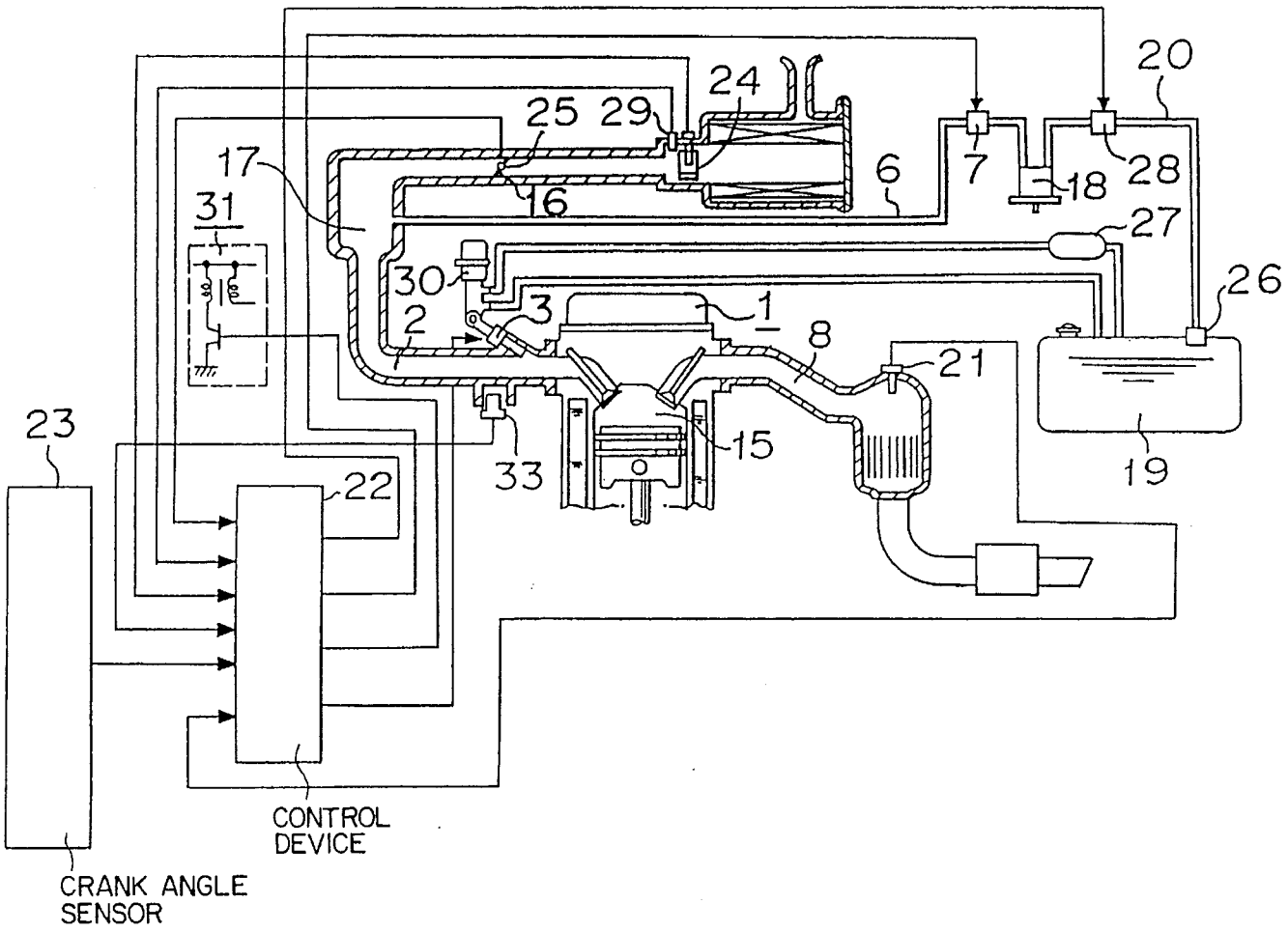
FIG. 1 is a construction diagram showing an embodiment of the present invention.

FIG. 1 is a diagram showing an embodiment of this invention, wherein numeral 1 designates an engine, and numeral 3 designates an electromagnetically driven injector for supplying fuel to the engine 1, which is installed to each cylinder. Numeral 24 designates an intake air quantity sensor for detecting an air quantity sucked to the engine, numeral 25 designates a throttle sensor which is installed to a portion of the intake air passage 2 and which detects an opening degree of an intake air throttle valve 16 that controls the intake air quantity sucked to the engine 1, numeral 29 designates an intake air temperature sensor for detecting an intake air temperature, numeral 31 designates an ignition device, and numeral 22 designates a control device for calculating control quantities based on signals from various sensors, and for performing a fuel and ignition control.

Further, numeral 23 designates a crank angle sensor for generating a signal per predetermined rotation of a crank shaft, numeral 19 designates a fuel tank, numeral 27 designates a fuel pump for pressurizing fuel, numeral 30 designates a fuel pressure regulator for maintaining constant the pressure of fuel supplying to the injector 3, numeral 8 designates an exhaust passage, and numeral 21 designates an air-fuel ratio sensor for detecting an oxygen concentration in the exhaust gas, which is installed in the exhaust passage 8. Further, constituent elements for supplying evaporated fuel which has been generated in the fuel tank 19 to the engine 1 are provided between the fuel tank 19 and the intake air passage 2, in a successive order from the side of the fuel tank 19, of a separator 26 for separating liquid fuel from the evaporated fuel, a passage to absorbent 20, a pressure control valve 28 for controlling the pressure in the fuel tank 19, a canister 18 for adsorbing the evaporated fuel, a purge control valve 7 for controlling a purge quantity for supplying the evaporated fuel which has once been adsorbed onto an adsorbent (for instance, activated carbon) of the canister 18, to the intake air passage 2 along with the outside air, and a purge passage 6.

Figure 2:
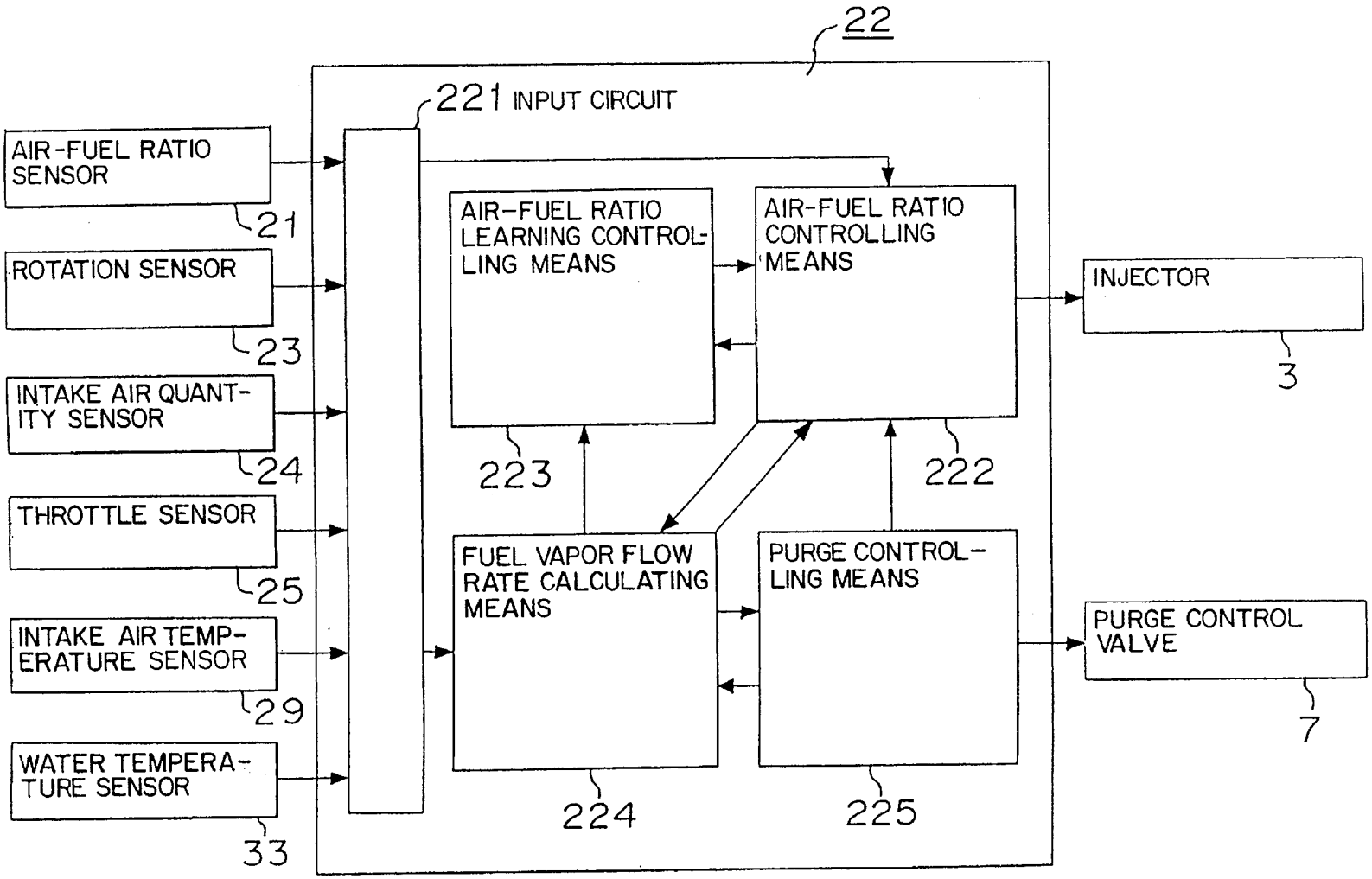
FIG. 2 is a block diagram showing a portion of the embodiment of the present invention.

Further, the control device 22 is constructed as shown in FIG. 2, wherein numeral 221 designates an input circuit for converting signals from various sensors in a form suitable for a microcomputer, numeral 222 designates an air-fuel ratio controlling means for calculating a supply quantity of fuel such that the air-fuel ratio becomes a suitable value based on various signals which have been processed by the input circuit, to thereby control the injector 3, numeral 223 designates an air-fuel ratio learning correcting means for calculating an air-fuel ratio learning correction quantity from the air-fuel ratio controlling means 222, to thereby correct the fuel quantity to be supplied, numeral 224 designates a fuel vapor flow rate calculating means for detecting an operational state of the engine from the various signals and calculating the flow rate of the fuel vapor in accordance thereto, and numeral 225 designates a purge controlling means for controlling the purge control valve 7 for supplying the fuel vapor having the flow rate which has been calculated by the fuel vapor flow rate calculating means 224, to the intake air passage 2. Further, as shown in FIG. 2, the air-fuel ratio controlling means 222, the air-fuel ratio learning correcting means 223, the fuel vapor flow rate calculating means 224 and the purge controlling means 225 mutually send and receive data, respectively.

Figure 3:
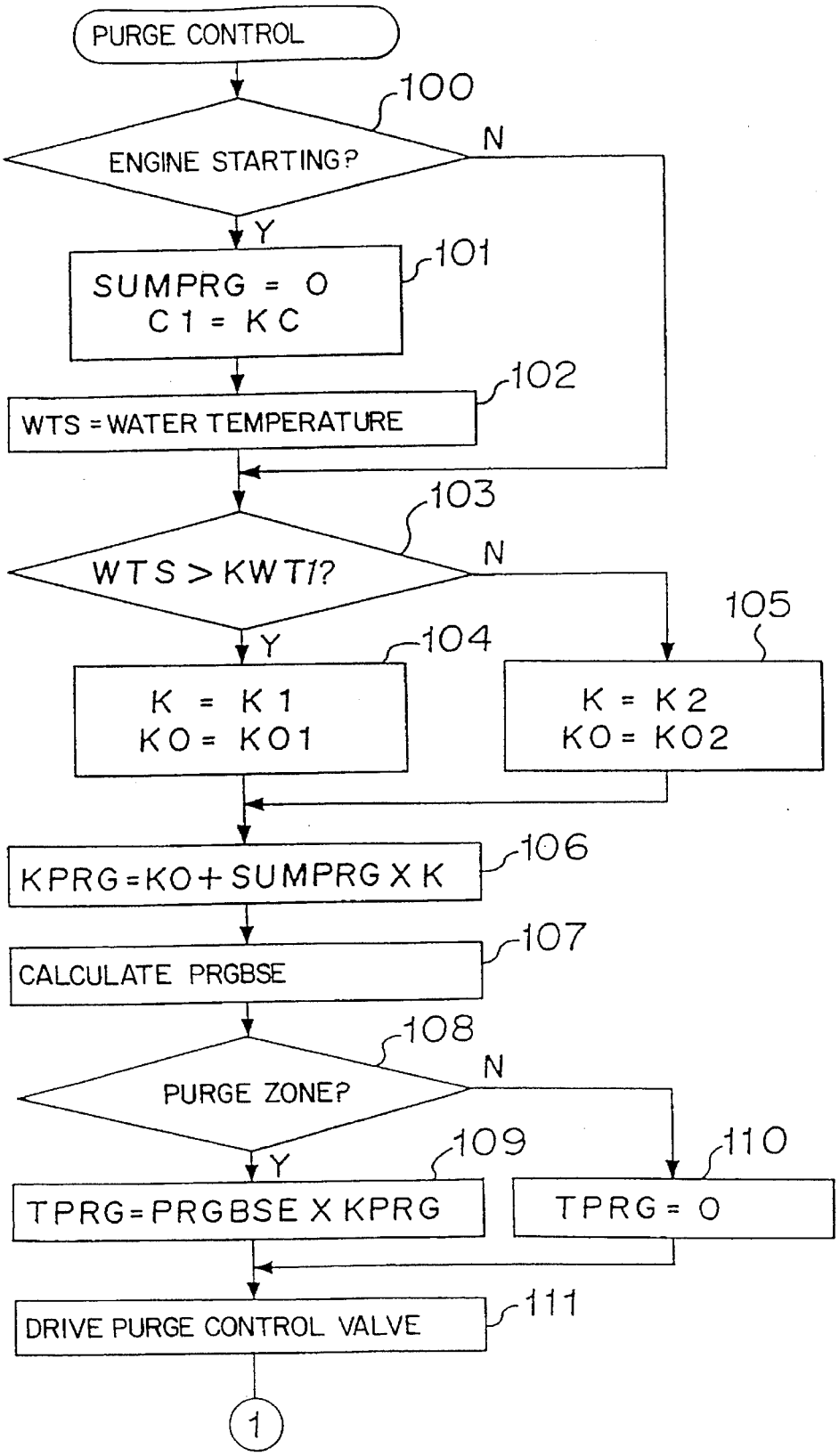
FIG. 3 is a flow chart for explaining the operation of the embodiment of the present invention.
Figure 4:
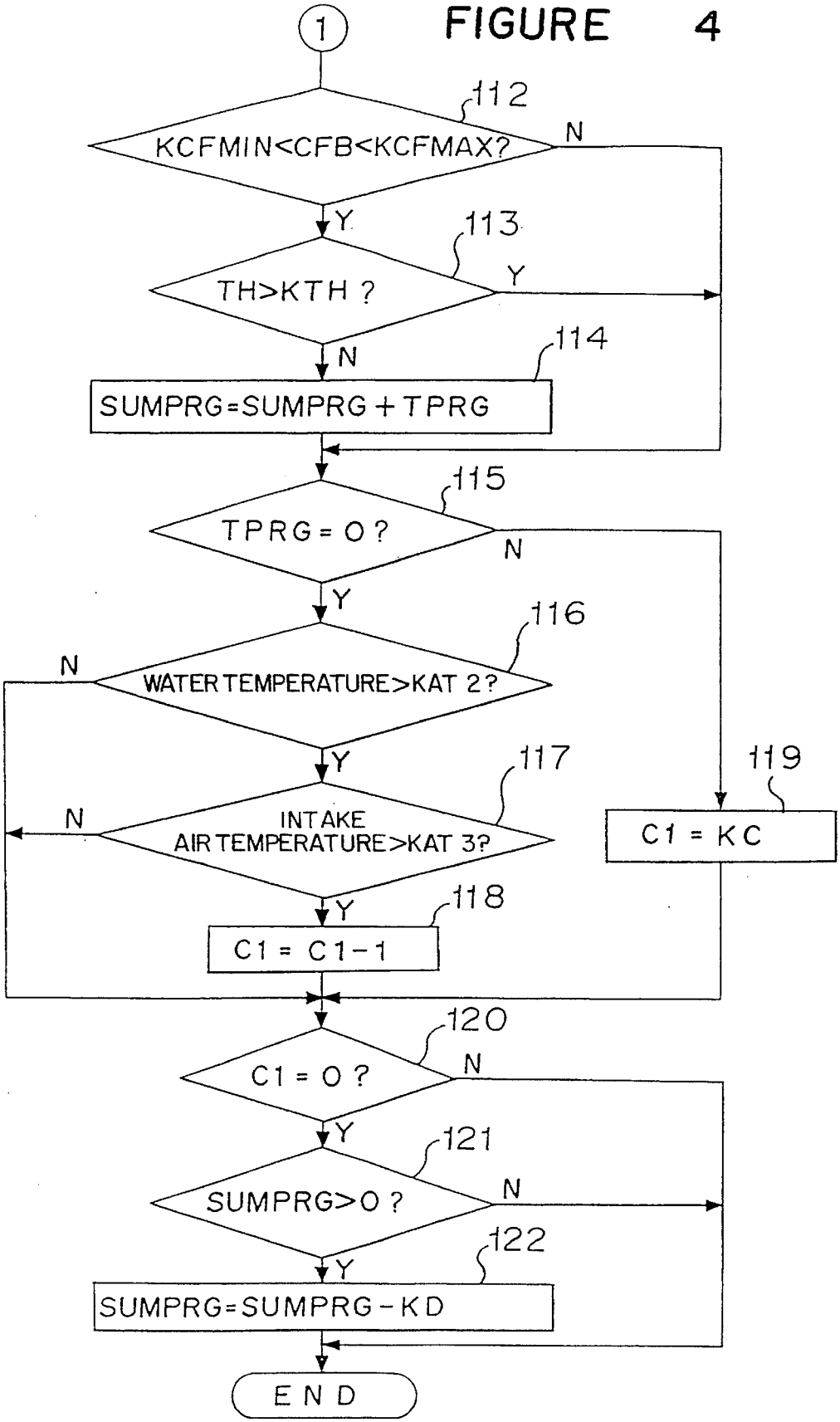
FIG. 4 is a flow chart for explaining the operation of the embodiment of the present invention.

Next, the major operation of the embodiment will be explained by flow charts of FIGS. 3 through 5. FIGS. 3 and 4 are flow charts for explaining the operation of the purge control, which are executed at every predetermined time period (for instance, every 100 ms).

First, in step 100, the operation determines whether the engine 1 is in the starting state or not. If the engine is not in the starting state, the operation proceeds to step 103. If the engine is in the starting state, the operation proceeds to 101 and determines a summation SUMPRG of operational periods of the purge control valve 7 and a value of a counter C1 as SUMPRG=0 and C1=KC (KC is an initial value of the counter C1), respectively. By the summation SUMPRG of the operational period of the purge control valve 7 (which corresponds to the opening degree of the purge control valve), a quantity of purging which has been performed since a predetermined state of the engine, that is, the starting state of the engine in this case, can be known, and the concentration of the fuel vapor can be estimated from the amount of purging. That is, it can be considered that, when the amount of purging is small, the quantity of the evaporated fuel in the canister is large and therefore, the concentration of the fuel vapor is large, whereas, when the amount of purging is large, the quantity of evaporated fuel in the canister is small, and hence, the concentration of the fuel vapor is small. Next, in step 102, the operation reads a water temperature WTS from a water temperature sensor in starting the engine. In step 103, the operation determines whether the water temperature WTS in starting the engine is higher than a first predetermined temperature KWT1 (for instance, 70° C.). When the water temperature WTS in starting the engine is higher than the first predetermined temperature KWT1 in the determination of the step 103, the operation proceeds to step 104 wherein the operation determines a coefficient K and an offset quantity KO as K=K1 and KO=KO1. When the temperature WTS is lower than the first predetermined temperature KWT1, the operation proceeds to step 105 wherein the operation determines the coefficient K and the offset quantity KO as K=K2 and KO=KO2 and thereafter, the operation proceeds to step 106. The relationships among the coefficients K1 and K2 and the offset quantities KO1 and KO2 are K1<K2 and KO1<KO2, respectively. In these steps 104 and 105, the operation alters the initial value of control and the change ratio of the summation of the purging quantity in the purge flow rate calculating means 224, by which the control corresponding to the quantity of the evaporated fuel can be performed.

In step 106, the operation calculates a correction coefficient KPRG for correcting the flow rate of the fuel vapor by calculating KPRG=KO+SUMPRG×K. In this way, the correction coefficient can corresponds to the concentration of the fuel vapor by determining the correction coefficient in accordance with the purging amount, by which the control corresponding to the concentration of the fuel vapor can be performed. In step 107, the operation calculates a basic valve opening time PRGBSE of the purge control valve 7 which is optimum to the operational state of the engine 1 by looking up a predetermined map, through the rotational speed of engine that can be calculated by signals from the crank angle sensor 23, the intake air quantity that can be calculated by the signal from the intake air quantity sensor 24, or by the charging efficiency calculated from these. In step 108, the operation determines whether the engine is in a purge control zone by the rotational speed of engine, the charging efficiency, the water temperature of engine and the like. When the engine is not in the purge control zone, the operation proceeds to step 110, wherein the operation determines the operational time period of the purge control valve 7, that is, a valve opening time period TPRG as TPRG=0.

When the engine is in the purge control zone in step 108, the operation proceeds to step 109 wherein the operation calculates the valve opening time period TPRG by the calculation of TPRG=PRGBSE×KPRG. When the correction coefficient KPRG of the flow rate of the fuel vapor is determined as KPRG=1, the valve opening time period TPRG of the purge control valve 7 is the basic valve opening time PRGBSE. When KPRG<1, the operation performs a correction to restrain the flow rate of the fuel vapor as smaller than the basic valve opening time PRGBSE. When KPRG>1, the operation performs a correction to increase the flow rate of the fuel vapor as larger than the basic valve opening time PRGBSE.

In step 111, the operation drives the purge control valve 7 in accordance with the valve opening time TPRG of the purge control valve 7 which has been determined by step 109 or step 110. With respect to the relationship between the opening degree of the purge control valve 7 and the valve opening time TPRG, the opening degree of the purge control valve composed of a duty solenoid valve corresponds to the valve opening time period TPRG by outputting pulses which correspond to the valve opening time period TPRG to the purge control valve at every predetermined time (in this case, every 100 ms).

Next, in FIG. 4, in step 112, the operation determines whether an air-fuel ratio correction coefficient CFB of the air-fuel ratio controlling means 222 is in a predetermined range (KCFMIN<CFB<KCFMAX). When the air-fuel ratio correction coefficient CFB is out of the above predetermined range, the air-fuel ratio is determined to considerably deviate by performing the purge control, the operation proceeds to step 115 without summing up the valve opening time period TPRG of the purge control valve 7 so as not to increase the flow rate of the fuel vapor further. When CFB is in the predetermined range, the operation proceeds to step 113, wherein the operation determines whether a throttle opening degree TH is larger than a predetermined opening degree KTH. When the throttle opening degree TH is larger than the predetermined opening degree KTH, the engine 1 is in a high load state and the pressure in the intake air passage 2 is large (on the side of an atmospheric pressure). Therefore, a case is considered wherein almost no purge fuel is introduced into the intake air passage 2 in spite of the operation of the purge control valve 7. Accordingly, the operation proceeds to step 115 without performing the summation of the valve opening time period TPRG of the purge control valve 7.

When the throttle valve opening degree TH is smaller than the predetermined opening degree KTH, in step 114, the operation calculates the summation SUMPRG of the valve opening time period of the purge control valve 7 by the calculation of SUMPRG=SUMPRG+TPRG. Here, with respect to the summation SUMPRG of the valve opening time period TPRG of the purge control valve 7 and the correction coefficient KPRG of the flow rate of the fuel vapor, as is apparent by the calculation formula in step 106, the correction coefficient increases when the summation increases, and the correction coefficient decreases when the summation decreases.

In step 115, the operation determines whether the valve opening time period TPRG of the purge control valve 7 is as TPRG=0. When not TPRG=0, the operation proceeds to step 119 wherein the operation resets the counter C1 (C1=KC) and proceeds to step 120. When TPRG=0, the operation proceeds to step 116. When TPRG=0, the purge control is in the state of switching-off, and the evaporated fuel in the canister 18 is not supplied to the engine 1.

Further, the evaporated fuel is generated in the fuel tank 19 irrespective of whether the purge control is operating or not operating, and adheres to the canister 18. The amount of the evaporated fuel in the canister 18 increases in a period when the purge control is not operating, and the increase in the amount of the evaporated fuel corresponds to a length of the period during which the purge control has been switched off.

Accordingly, it is possible to perform a control which corresponds to the amount of the evaporated fuel in the canister 18, that is, which corresponds to the concentration of the fuel vapor, by correcting the flow rate of the fuel vapor in accordance with the length of the period during which the purge control has been switched off, by which the influence on the air-fuel ratio can be minimized.

When TPRG=0 in step 115, the operation proceeds to step 116 wherein the operation determines whether the water temperature is higher than a second predetermined temperature KWT2 (for instance, 80° C.). When the water temperature is lower than the second predetermined temperature KWT2, the operation proceeds to step 120. When the water temperature is higher than the second predetermined temperature KWT2, the operation proceeds to step 117. In step 117, the operation determines whether the intake air temperature is higher than a third predetermined temperature KAT3 (for instance, 40° C.). When the intake air temperature is lower than the third predetermined temperature KAT3, the operation proceeds to step 120. When the intake air temperature is higher than the third predetermined temperature KAT3, the operation proceeds to step 118 wherein the operation counts down the counter C1 and proceeds to step 120.

In step 120, the operation determines whether the counter C1 is as C1=0. When not C1=0, the operation finishes the processing. When C1=0, the operation proceeds to step 121 and determines whether SUMPRG>0. When SUMPRG>0, the operation proceeds to step 122. When not SUMPRG>0, the operation finishes the processing. In step 122, the operation reduces the summation SUMPRG of the valve opening time period TPRG of the purge control valve 7 by the calculation of SUMPRG=SUMPRG−KD (in this case, KD is a predetermined value), and the operation finishes the processing. In step 116 through step 122, since the concentration of the fuel vapor is increased in accordance with the length of the period during which the purge control has been switched off, the summation SUMPRG of the valve opening period TPRG of the purge control valve 7 is reduced to correspond to the increase in the fuel vapor concentration.

However, even in a state wherein the purge control is switched off, in case wherein the surrounding temperature or the engine temperature is low, the amount of the evaporated fuel which has been generated in the fuel tank 19 is small, the amount thereof which has been adsorbed onto the canister 18 is very small, and the concentration of the fuel vapor is not influenced at all. Therefore, the operation ignores the period wherein the purge control has been switched off, and prohibits to reduce the summation SUMPRG of the valve opening time period TPRG of the purge control valve 7. By this operation, it is possible to perform a control whereby the concentration of the fuel vapor accurately corresponds to the correction coefficient KPRG of the flow rate of the fuel vapor.

Figure 5:
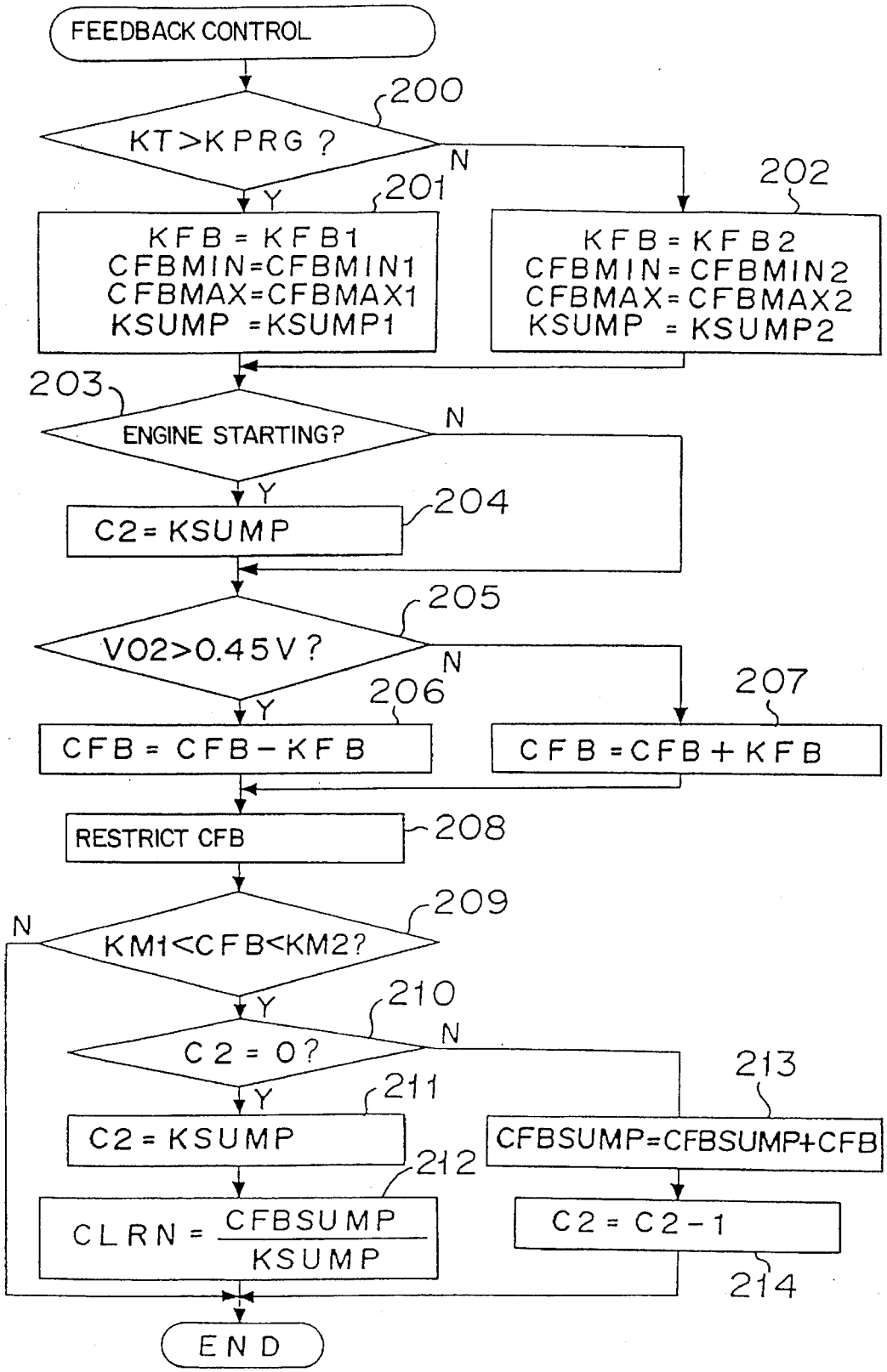
FIG. 5 is a flow chart for explaining the operation of the embodiment of the present invention.
Figure 6:
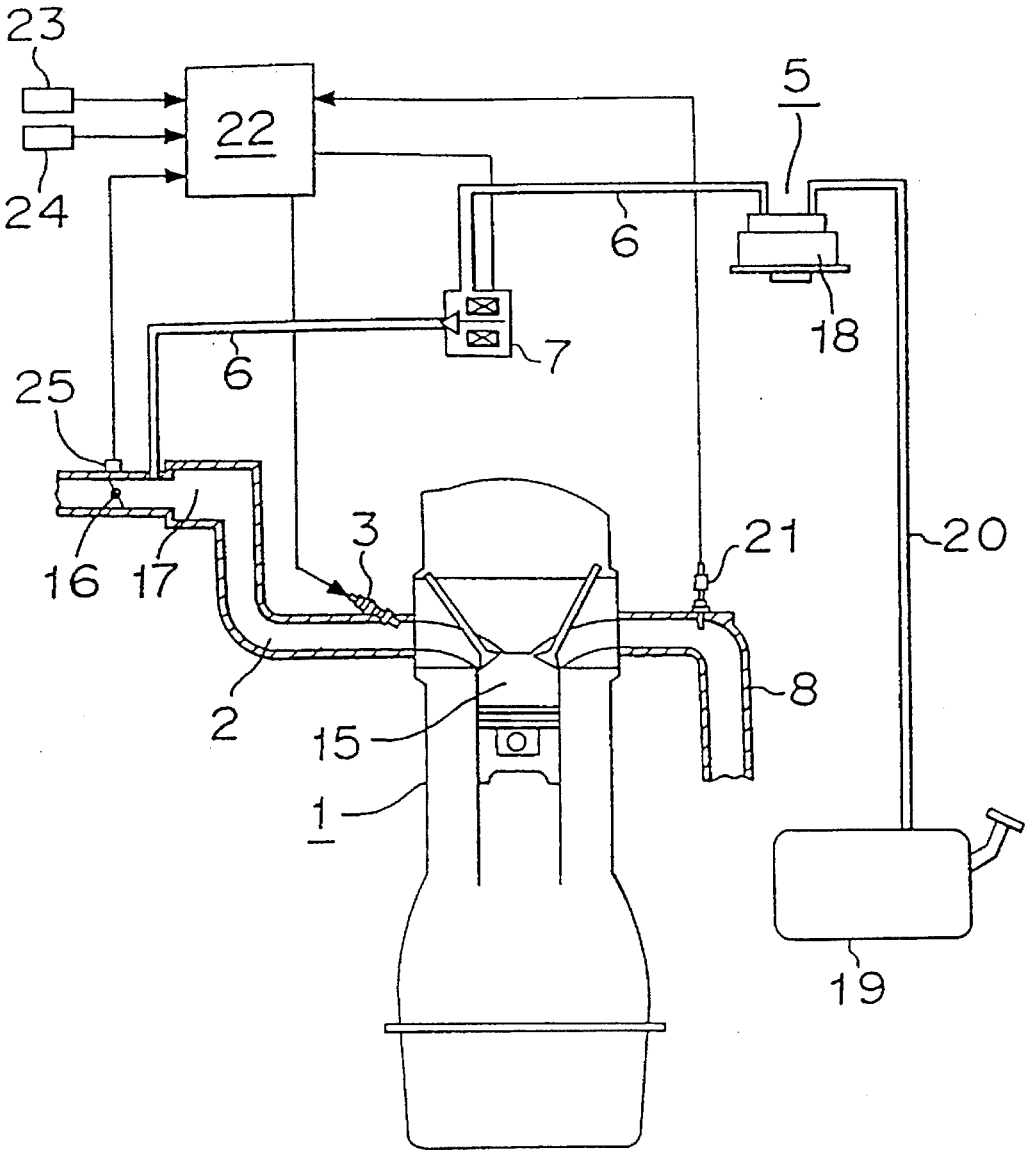
FIG. 6 is a construction diagram showing a conventional air-fuel ratio control device for an engine.
Figure 7:
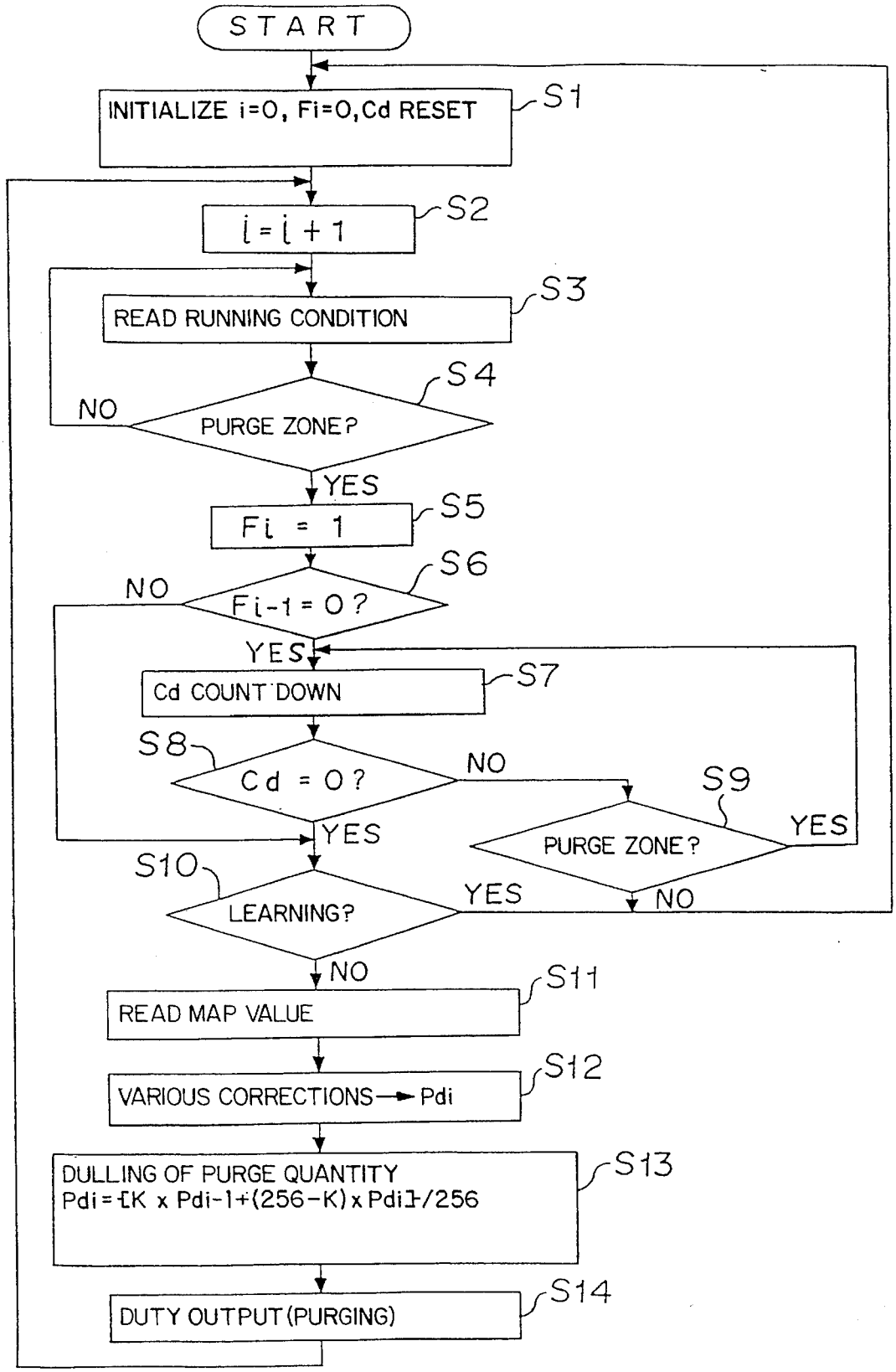
FIG. 7 is a flow chart showing the control of the conventional device.

FIG. 5 is a flow chart for explaining a control operation of an air-fuel ratio by a feedback control, which is performed at every predetermined crank angle or predetermined time (for instance, 25 ms).

First, in step 200, the operation determines whether the correction coefficient KPRG employed in the purge air flow rate calculating means 224 is not larger than a predetermined quantity (KT>KPRG). When the correction coefficient KPRG is not larger than the predetermined value, the operation proceeds to step 201. When the correction coefficient KPRG is not smaller than the predetermined quantity, the operation proceeds to step 202. In step 201 and step 202, the operation respectively determines updated quantities KFB of the air-fuel ratio correction coefficient CFB, minimum values CFBMIN and maximum values CFBMAX of the air-fuel ratio correction coefficient CFB, and numbers of sampling for calculating learning value KSUMP.

When the correction coefficient KPRG of the flow quantity of the fuel vapor is not larger than the predetermined quantity, the summation SUMPRG of the valve opening time period TPRG of the purge control valve 7 is expected to be small and the concentration of the fuel vapor is expected to be large, and the air-fuel ratio will be expected to considerably deviate by the execution of the purge control. In correspondence thereto, in steps 201 and 202, the operation alters the updated quantities and the ranges of the air-fuel ratio correction coefficient CFB of the air-fuel ratio controlling means 222, and the numbers of sampling for calculating learning value of the air-fuel ratio learning correcting means, by the value of the correction coefficient KPRG of the fuel vapor flow rate calculating means 224. The relationships among the above respective values are KFB1>KFB2, CFBMIN1<CFBMIN2, CFBMAX1>CFBMAX2, and KSUMP1<KSUMP2. By switching the updated quantities KFB of the air-fuel ratio correction coefficient CFB and their ranges by the correction coefficient of the fuel vapor flow rate calculating circuit, it is possible to swiftly correspond to a case wherein the air-fuel ratio has been deviated in a large amount. By switching the numbers of sampling for the learning calculation, it is possible to swiftly correspond to the change in the concentration of the fuel vapor by the execution of the purging, by accelerating the speed of the learning calculation.

In step 203, the operation determines whether the engine in the starting state. When the engine is not in the starting state, the operation proceeds to step 205. When the engine is in the starting state, the operation proceeds to step 204 wherein the operation initializes a counter C2 (C2=KSUMP) and proceeds to step 205. In step 205, the operation determines whether a voltage VO2 of the air-fuel ratio sensor 21 is as VO2>0.45 V. When VO2>0.45 V, the air-fuel ratio is in a rich state, and the operation proceeds to step 206 and calculates the air-fuel ratio correction coefficient CFB by the calculation of CFB=CFB−KFB. When not VO2>0.45 V, the air-fuel ratio is in a lean state, the operation proceeds to step 207 and calculates the air-fuel ratio correction coefficient CFB by the calculation of CFB=CFB+KFB. In step 208, the operation restricts the air-fuel ratio correction coefficient CFB which has been obtained by step 206 or step 207 by the ranges of the minimum values CFBMIN to the maximum values CFBMAX which have been determined by step 201 or step 202. An erroneous operation of the air-fuel ratio controlling means by a noise or the like can be prevented by restricting the air-fuel ratio correction coefficient CFB.

In step 209, the operation determines whether the air-fuel ratio correction coefficient CFB is in a predetermined range (KM1>CFB>KM2). When the air-fuel ratio correction coefficient CFB is out of the predetermined range, it is considered that the air-fuel ratio is considerably deviated by the purge control, and therefore, the operation finishes the processing without performing the calculation of the air-fuel ratio learning correction quantity. When the air-fuel ratio correction coefficient CFB is in the predetermined range, the operation proceeds to step 210 wherein the operation determines whether the counter C2 is as C2=0. When not C2=0, the operation proceeds to step 213, calculates a summation CFBSUMP of the air-fuel ratio correction coefficient CFB by CFBSUMP=CFBSUMP+CFB, and counts down the count C2 in step 214, thereby finishing the processing.

When C2=0 in step 210, since the sampling the air-fuel ratio correction coefficient CFB for calculating an air-fuel ratio learning correction quantity CLRN, is finished, in step 211, the operation resets the initial value KSMP of the counter C2, and in step 212, the operation calculates the air-fuel ratio correction quantity CLRN by the calculation of CLRN=CFBSUMP/KSUMP thereby finishing the processing. After finishing the processing shown in the flow chart of FIG. 5, the air-fuel ratio controlling means 222 controls the air-fuel ratio by driving the injector 3 with a value of the basic injection quantity which has been calculated by the outputs of the crank angle sensor 23, the intake quantity sensor 24 and the like and which has been corrected by the air-fuel ratio correction coefficient CFB and the air-fuel ratio learning correction quantity CLRN. By performing the above control, it is possible to swiftly corresponds to the deviation of the air-fuel ratio due to the execution of the purge control, and it is also possible to prevent the deviation of the air-fuel ratio by the purge control from reflecting on the air-fuel ratio learning correction quantity.

EXAMPLE 2

In FIG. 3 and 4 in the above Example 1, the operation looks up the basic valve opening time PRGBSE of the purge control valve 7 by a map in step 107, and corrects it in step 109 thereby calculating the actual valve opening time period TPRG of the purge control valve 7, drives the purge control valve in accordance with this valve opening time period TPRG in step 111, calculates the summation SUMPRG of the valve opening time period TPRG of the purge control valve 7, that is, calculates the valve opening time, in step 114, drives the purge control valve 7 in accordance thereto, and sums up the valve opening time period again. However, the same effect can be provided by the following procedure. A map of a fuel vapor basic control flow rate APRGBSE is previously formed instead of the map of the basic valve opening time period PRGBSE, the operation looks up the purge air control flow rate APRGBSE from this map in step 107, corrects it in the step 109, thereby calculating an actual fuel vapor control flow rate APRG, calculates the valve opening time period of the purge control valve from a map previously formed based on the purge control flow rate APRG in step 111, drives the purge control valve 7 in accordance thereto, calculates a summation SUMPRG of this fuel vapor control flow rate APRG, or calculates the control flow rate, in step 114, calculates the valve opening time period in correspondence thereto, drives the purge control valve 7 in accordance with the valve opening time, and sums up the control flow rate again.

Further, in step 109 and step 111, calculations of a battery voltage correction, an atmospheric pressure correction and the like of the purge control valve 7 may be added to more accurately calculate the valve opening time period of the purge control valve 7.

EXAMPLE 3

In FIG. 3 of the Example 1, the water temperature of the engine in starting is detected in step 102, the coefficient K and the offset quantity KO are switched to K1 and KO1 or K2 and KO2 by the water temperature of the engine, in step 103. However, the coefficients K and KO may be switched by an outside air temperature in starting the engine or the water temperature and the outside air temperature in starting the engine.

EXAMPLE 4

In FIG. 4 of the above Example 1, the operation determines whether the air-fuel ratio correction coefficient CFB is in the predetermined range (KCFMIN<CFB<KCFMAX) in step 112, and proceeds to step 115 when CFB is out of the predetermined range, without performing the summation of the valve opening time period TPRG of the purge control valve 7 in step 114, so as not to increase the flow rate of the fuel vapor by judging that the air-fuel ratio will considerably be deviated by the execution of the purge control in case wherein the air-fuel ratio correction coefficient CFB is out of the predetermined range. However, in case wherein the air-fuel ratio correction coefficient CFB is out of the predetermined range by the determination in step 112, a predetermined quantity may be reduced from the summation SUMPRG of the valve opening time period TPRG of the purge control valve 7 thereby reducing the flow rate of the fuel vapor.

EXAMPLE 5

In FIG. 4 of the above Example 1, the operation determines whether the engine is in a high load state based on the throttle opening degree TH in step 113. However, the same effect can be provided by performing the determination based on the intake air quantity which is obtained by the signal from the intake air quantity sensor 24, or based on the charging efficiency which is obtained by the intake air quantity and the rotation number of the engine which is obtained by the signal from the crank angle sensor 23. Further, when the engine is determined to be in a high load state in step 113, the operation proceeds to step 115 without performing the summation of the valve opening time period TPRG of the purge control valve 7 in step 114. However, in case wherein the engine is determined to be in a high load state in step 113, a value correcting the valve opening time period TPRG of the purge control valve 7 may be summed up.

Further, in the above explanation, a case has been disclosed wherein a plurality of controls are assembled. However, the individual control per se naturally achieves an effect particular the respective control.

This invention as constructed as explained above achieves the following effects.

The invented control device predicts the amount of the evaporated fuel which has been adsorbed in the canister in the period during which this purge control has been switched off from the length of at least the period of the switching-off of the purge control immediately before the purge control is switched on, and corrects the flow rate of the fuel vapor when the purge control is switched on in accordance thereto. Therefore, the control corresponding to the concentration of the purge air can be performed, which can minimizes the influence on the air-fuel ratio.

Further, the invented control device accurately predicts the amount of the evaporated fuel which has been adsorbed in the canister in the period of the switching-off the purge control from the length of at least the period of the switching-off of the purge control immediately before the purge control is switched on, and the amount of the evaporated fuel which remains in the canister when the purge control is switched on from the opening degree of the purge control valve during the preceding period of the switching-on of the purge control, and the length of the preceding period, and corrects the flow rate of the fuel vapor when the purge control is switched on in accordance thereto. Therefore, it is possible to perform the control accurately corresponding to the concentration of the fuel vapor, and to minimize the influence on the air-fuel ratio.

Further, the invented control device predicts the amount of the evaporated fuel which has been generated in the fuel tank before starting the engine by the engine temperature or the surrounding temperature in starting the engine, and switches the initial values of control to perform the control in correspondence thereto, thereby enabling to perform the control corresponding to the amount of the evaporated fuel which has been generated in the fuel tank and minimizing the influence on the air-fuel ratio.

Further, the invented control device calculates the correction value the size of which gradually changes in one direction corresponding to the opening degree of the purge control valve when the purge control is switched on, and gradually changes in the other direction when the purge control is switched off, and calculates the flow rate of the fuel vapor when the purge control is switched on by the correction value, thereby enabling to perform the purge control in accordance with the concentration of the fuel vapor and further minimizing the influence on the air-fuel ratio.

Further, when the amount of the evaporated fuel from the fuel tank is determined to be small, the invented control device restrains the change of the correction value of the flow rate of the fuel vapor when the purge control is switched off, thereby enabling to accurately correspond the correction value of the flow rate of the fuel vapor to the concentration of the fuel vapor.

Further, when the engine is in a high load state, the pressure of the intake passage of the engine is increased, and it is conceivable that almost no fuel vapor can be supplied to the engine even when the purge control valve is opened. In this case, the invented control device restrains the change of the correction value of the flow rate of the fuel vapor when the purge control is switched on, thereby accurately corresponding the correction value of the flow rate of the fuel vapor to the concentration of the fuel vapor, and accurately performing the control which corresponds to the concentration of the fuel vapor.

Further, when the air-fuel ratio correction coefficient of the air-fuel ratio control means is in a predetermined range, it is conceivable that the air-fuel ratio is considerably deviated by the execution of the purge control. In this case, the invented control device stops the change of the correction value of the flow rate of the fuel vapor when the purge control is switched on, thereby enabling to prevent the control from further deviating the air-fuel ratio.

Further, when the correction value of the flow rate of the fuel vapor becomes a value which corrects to reduce the flow rate of the fuel vapor by not less than a predetermined value, it is predicted that the air-fuel ratio is considerably deviated by the execution of the purge control. In this case, the invented control device expands the control range of the air-fuel ratio correction coefficient, thereby enabling to promote the response performance of the air-fuel ratio control and to correspond thereto even when the air-fuel ratio is considerably deviated. Further, when the control range is not intended to expand, the invented control device can prevent an erroneous operation of the air-fuel ratio control by a noise or the like, by restricting the air-fuel ratio correction coefficient in a narrow range.

Further, when the correction value of the flow rate of the fuel vapor becomes a value which corrects to reduce the flow rate of the fuel vapor by not less than a predetermined value, it is predicted that the air-fuel ratio is considerably deviated by the execution of the purge control. In this case, the invented control device can promote the response performance of the air-fuel ratio control by enlarging the amount of the change of the air-fuel ratio correction coefficient, thereby enabling to swiftly correspond to the deviation of the air-fuel ratio.

Further, when the correction value of the flow rate of the fuel vapor becomes a value which corrects to reduce the flow rate of the fuel vapor by not less than a predetermined value, it is predicted that the air-fuel ratio is considerably deviated by the execution of the purge control. In this case, the invented control device can promote the response performance of the air-fuel ratio control and swiftly correspond to the deviation of the air-fuel ratio by accelerating the calculating speed of the air-fuel ratio learning correction quantity.

Further, when the air-fuel ratio correction coefficient is out of a predetermined range, it is conceivable that the air-fuel ratio is considerably deviated. In this case, the invented control device prevents the deviation of the air-fuel ratio from reflecting on the air-fuel ratio learning correction quantity by prohibiting the calculation of the air-fuel ratio learning coefficient quantity, thereby enabling to perform the normal air-fuel ratio control.

Further, the invented control device predicts the amount of the evaporated fuel which has been generated in the fuel tank before starting the engine, by the engine temperature or the surrounding temperature in starting the engine, and switches the ratios of the change of the correction value of the flow rate of the fuel vapor, thereby enabling to perform the control which corresponds to the amount of the evaporated fuel which has been generated in the fuel tank, and enabling to minimize the influence on the air-fuel ratio.

What is claimed is:

1. An electronic control device for an internal combustion engine comprising:

fuel controlling means for controlling a quantity of fuel supplied to an engine;

an air-fuel ratio sensor for detecting an air-fuel ratio from an exhaust gas;

air-fuel ratio controlling means for calculating an air-fuel ratio correction coefficient such that the air-fuel ratio of fuel vapor supplied to the engine has a predetermined value based on a signal from the air-fuel ratio sensor, and for controlling the fuel controlling means by a feedback control;

a purge passage for supplying to the engine evaporated fuel which has evaporated in a fuel tank;

a canister provided in the purge passage for adsorbing the evaporated fuel;

fuel vapor flow rate calculating means for switching on or off a purge control based on a running condition of the engine and for calculating a flow rate of the fuel vapor wherein the evaporated fuel which has been adsorbed by the canister is mixed with air in accordance with an operating state of the engine when the purge control is switched on; and purge controlling means for driving a purge control valve provided between the canister and an intake air passage such that the calculated flow rate of the fuel vapor is supplied to the engine;

wherein the fuel vapor flow rate calculating means corrects the flow rate of the fuel vapor when the purge control is switched on based on at least a period of time that the purge control has been switched off immediately before the purge control is switched on.

2. An electronic control device for an internal combustion engine comprising:

fuel controlling means for controlling a quantity of fuel supplied to an engine;

an air-fuel ratio sensor for detecting an air-fuel ratio from an exhaust gas;

air-fuel ratio controlling means for calculating an air-fuel ratio correction coefficient such that the air-fuel ratio of fuel vapor supplied to the engine has a predetermined value based on a signal from the air-fuel ratio sensor, and for controlling the fuel controlling means by a feedback control;

a purge passage for supplying to the engine evaporated fuel which has evaporated in a fuel tank;

a canister provided in the purge passage for adsorbing the evaporated fuel;

fuel vapor flow rate calculating means for switching on or off a purge control in correspondence to a running condition of the engine and for calculating a flow rate of the fuel vapor wherein the evaporated fuel which has been adsorbed by the canister is mixed with air in accordance with an operating state of the engine when the purge control is switched on; and purge controlling means for driving a purge control valve provided between the canister and an intake air passage such that the calculated flow rate of the fuel vapor is supplied to the engine;

wherein the fuel vapor flow rate calculating means corrects the flow rate of the fuel vapor when the purge control is switched on based on at least a period of time that the purge control has been switched off immediately before the purge control is switched on, a degree which the purge control valve was opened during a preceding period of time during which the purge control was switched on, and a length of the preceding period of time.

3. The electronic control device for an internal combustion engine according to claim 1 or claim 2, wherein the fuel vapor flow rate calculating means switches initial values of control based on a temperature of the engine or a surrounding temperature in starting the engine.

4. The electronic control device for an internal combustion engine according to claim 3, wherein the fuel vapor flow rate calculating means calculates a correction value, a size of which gradually changes in one direction in correspondence to the degree which the purge control valve is opened when the purge control is switched on and gradually changes in another direction when the purge control is switched off, thereby correcting the flow rate of the fuel vapor when the purge control is switched on.

5. The electronic control device for an internal combustion engine according to claim 4, wherein the fuel vapor flow rate calculating means does not change the correction value of the flow rate of the fuel vapor when the purge control is switched off in a case in which an amount of the evaporated fuel generated in the fuel tank is determined to be small.

6. The electronic control device for an internal combustion engine according to claim 4, wherein the fuel vapor flow rate calculating means does not change of the correction value of the flow rate of the fuel vapor when the purge control is switched on in a case in which the engine is determined to be in a high load state.

7. The electronic control device for an internal combustion engine according to claim 4, wherein the fuel vapor flow rate calculating means stops the change of the correction value of the flow rate of the fuel vapor when the purge control is switched on in a case wherein the air-fuel ratio correction coefficient of the air-fuel ratio controlling means is out of a predetermined range.

8. The electronic control device for an internal combustion engine according to claim 4, wherein a control range of the air-fuel ratio correction coefficient of the air-fuel ratio controlling means is expanded in a case wherein the correction value of the flow rate of the fuel vapor of the fuel vapor flow rate calculating means becomes a value which reduces the flow rate of the fuel vapor by not less than a predetermined value.

9. The electronic control device for an internal combustion engine according to claim 4, wherein a quantity of change of the air-fuel ratio correction coefficient of the air-fuel ratio controlling means is increased in a case wherein the correction value of the flow rate of the fuel vapor of the fuel vapor flow rate calculating means becomes a value which reduces the flow rate of the fuel vapor by not less than a predetermined value.

10. The electronic control device for an internal combustion engine according to claim 4, further comprising:

air-fuel ratio learning correcting means for calculating an air-fuel ratio learning correction quantity from the air-fuel ratio correction coefficient of the air-fuel ratio controlling means thereby correcting a quantity of fuel supplied to the engine;

wherein a calculating speed of the air-fuel ratio learning correction quantity of the air-fuel ratio learning correcting means is accelerated in a case wherein the correction value of the fuel vapor of the fuel vapor flow rate calculating means becomes a value which reduces the flow rate of the fuel vapor by not less than a predetermined value.

11. The electronic control device for an internal combustion engine according to claim 4, further comprising:

air-fuel ratio learning correcting means for calculating an air-fuel ratio learning correction quantity from the air-fuel ratio correction coefficient of the air-fuel ratio controlling means thereby correcting a quantity of fuel supplied to the engine;

wherein a calculation of the air-fuel ratio learning correction quantity of the air-fuel ratio learning correcting means is prohibited in case wherein the air-fuel ratio correction coefficient of the air-fuel ratio controlling means is out of a predetermined range.

12. The electronic control device for an internal combustion engine according to claim 4, wherein the fuel vapor flow rate calculating means switches ratios for changing the correction value of the flow rate of the fuel vapor by a temperature of the engine or a surrounding temperature in starting the engine.

* * * * *